US008970439B2

(12) United States Patent
Maxwell

(10) Patent No.: US 8,970,439 B2
(45) Date of Patent: Mar. 3, 2015

(54) SYSTEM AND METHOD FOR A DYNAMIC LIQUID CORE PATCH ANTENNA AND BROADBAND FREQUENCY AGILITY

(75) Inventor: Erick N. Maxwell, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 197 days.

(21) Appl. No.: 13/466,001

(22) Filed: May 7, 2012

(65) Prior Publication Data

US 2012/0280870 A1 Nov. 8, 2012

Related U.S. Application Data

(60) Provisional application No. 61/483,158, filed on May 6, 2011.

(51) Int. Cl.

| | |
|---|---|
| ***H01Q 9/00*** | (2006.01) |
| ***H01Q 9/14*** | (2006.01) |
| ***H01Q 1/38*** | (2006.01) |
| ***H01Q 9/04*** | (2006.01) |

(52) U.S. Cl.

CPC ..... *H01Q 9/145* (2013.01); *H01Q 1/38* (2013.01); *H01Q 9/0442* (2013.01)

USPC ..... 343/745

(58) Field of Classification Search

CPC ..... H01Q 1/38; H01Q 9/0442; H01Q 9/145

USPC ..... 343/745

See application file for complete search history.

(56) References Cited

U.S. PATENT DOCUMENTS

| | | | | |
|---|---|---|---|---|
| 7,023,384 | B2 * | 4/2006 | Brown et al. | 343/700 MS |
| 7,773,044 | B2 * | 8/2010 | Oksanen et al. | 343/787 |
| 2005/0057415 | A1 * | 3/2005 | Rawnick et al. | 343/795 |

* cited by examiner

*Primary Examiner* — Robert Karacsony

(74) *Attorney, Agent, or Firm* — Troutman Sanders LLP; Ryan A. Schneider; Christopher W. Glass

(57) ABSTRACT

An exemplary embodiment of the present invention provides a tunable liquid core patch antenna comprising a top-side patch, a ground plane, and a liquid core substrate positioned substantially between the top-side patch and the ground plane. The liquid core substrate can comprise a first liquid having a first dielectric constant and a second liquid having a second dielectric constant greater than the first dielectric constant. The first liquid and second liquid can form a mixture having an effective dielectric constant greater than the first dielectric constant and less than the second dielectric constant.

6 Claims, 4 Drawing Sheets

SYSTEM AND METHOD FOR A DYNAMIC LIQUID CORE PATCH ANTENNA AND BROADBAND FREQUENCY AGILITY

CROSS-REFERENCE TO RELATED APPLICATIONS

This application claims the benefit of U.S. Provisional Application Ser. No. 61/483,158, filed on 6 May 2011, which is incorporated herein by reference in its entirety as if fully set forth below.

TECHNICAL FIELD OF THE INVENTION

The various embodiments of the present disclosure relate generally to antennas. More particularly, the various embodiments of the present invention are directed to systems and methods for dynamically tuning antennas.

BACKGROUND OF THE INVENTION

Conventional antennas are generally manufactured to operate at a single resonant frequency. Accordingly, many antennas are necessary to make use of the many radio-frequency ("RF") channels available. To combat this problem, some conventional techniques have been proposed to tune the antenna, i.e. alter the antennas operating resonant frequency. For example, in a conventional patch antenna, one proposed technique for tuning the antenna involves applying a reactance at the edges of the patch using capacitors or diodes. Although this technique has provided improved results over some conventional antennas by achieving a tuning bandwidth of about 50% or a fractional bandwidth of about 1.67:1, the limited total capacitance associated with the diodes and/or capacitors has not permitted dynamic tunability across the attainable band for wide-bandwidth antennas.

Therefore, there is a desire for improved tunable antennas and methods of using the same. Various embodiments of the present invention address this desire.

BRIEF SUMMARY OF THE INVENTION

The present invention relates to tunable antennas and methods for tuning the operating resonant frequency of an antenna. An exemplary embodiment of the present invention provides a tunable liquid core patch antenna comprising a top-side patch, a ground plan and a liquid core substrate positioned substantially between the top-side patch and the ground plane. The liquid core substrate can comprise a first liquid having a first dielectric constant and a second liquid having a second dielectric constant greater than the first dielectric constant. The first liquid and second liquid can form a mixture within the liquid core substrate having an effective dielectric constant greater than the first dielectric constant and less than the second dielectric constant.

In another exemplary embodiment of the present invention, the tunable liquid core patch antenna can further comprise a first liquid inlet in fluid communication with the liquid core substrate and configured to inject the first liquid into the liquid core substrate. In yet another exemplary embodiment of the present invention, the liquid core substrate comprises a second liquid inlet in fluid communication with the liquid core substrate and configured to inject the second liquid into the liquid core substrate. In still another exemplary embodiment of the present invention, the tunable liquid core patch antenna comprises a liquid outlet in fluid communication with the liquid core substrate and configured to eject at least a portion of the mixture out of the liquid core substrate. In still yet another exemplary embodiment of the present invention, the tunable liquid core patch antenna comprises a mixing element configured to mix the first liquid and the second liquid to form the mixture.

In some embodiments of the present invention, at least one of the top-side patch and ground plane comprises at least one electrically conductive material, e.g. copper, gold, or silver. In some embodiments of the present invention, the effective dielectric constant corresponds to an operating resonant frequency of the patch antenna. In an exemplary embodiment of the present invention, the tunable liquid core patch antenna comprises a pressure relief port in fluid communication with the liquid core substrate configured to regulate a pressure of the mixture within the liquid core substrate.

Another exemplary embodiment of the present invention provides a method of dynamically tuning an antenna to a desired operating resonant frequency comprising injecting a first amount of a first liquid into a liquid core substrate of the antenna, the first liquid having a first dielectric constant, and injecting a second amount of a second liquid into the liquid core substrate, the second liquid having a second dielectric constant greater than the first dielectric constant. In an exemplary embodiment of the present invention, the first amount of the first liquid and the second amount of the second liquid form a mixture having an effective dielectric constant greater than the first dielectric constant and less than the second dielectric constant. In some embodiments of the present invention, the effective dielectric constant corresponds to the desired operating resonant frequency.

In another exemplary embodiment of the present invention, the method comprises injecting a third amount of a third liquid into the liquid core substrate, wherein the first amount of the first liquid, the second amount of the second liquid, and the third amount of the third liquid form a mixture having an effective dielectric constant. In some embodiments of the present invention, injecting the first amount of the first liquid and injecting the second amount of the second liquid occur during continuous operation of the antenna. In some embodiments of the present invention, injecting the third amount of the third liquid occurs during continuous operation of the antenna. The third liquid can be many liquids, including, but not limited to, the first liquid, the second liquid, and another distinct liquid.

In some embodiments of the present invention, the first amount of the first liquid is injected via a first liquid inlet in fluid communication with the liquid core substrate. In some embodiments of the present invention, the second amount of the second liquid is injected via a second liquid inlet in fluid communication with the liquid core substrate. In some embodiments of the present invention, the first amount of the first liquid and the second amount of the second liquid are injected via a liquid inlet in fluid communication with the liquid core substrate. In some embodiments of the present invention, the first amount of the first liquid and the second amount of the second liquid are mixed to form a mixture prior to being injected via the liquid inlet.

In an exemplary embodiment of the present invention, the method comprises mixing the first amount of the first liquid and the second amount of the second liquid to form the mixture. In another exemplary embodiments of the present invention, mixing the first amount of the first liquid and the second amount of the second liquid comprises injecting the first liquid and second liquid into the liquid core substrate via a plurality of liquid inlets.

In yet another exemplary embodiment of the present invention, the method comprises injecting a third amount of one of the first liquid or second liquid to change the effective dielectric constant of the mixture. In some embodiments of the present invention, injecting the third amount of one of the first liquid or second liquid alters the operating resonant frequency of the antenna.

These and other aspects of the present invention are described in the Detailed Description of the Invention below and the accompanying figures. Other aspects and features of embodiments of the present invention will become apparent to those of ordinary skill in the art upon reviewing the following description of specific, exemplary embodiments of the present invention in concert with the figures. While features of the present invention may be discussed relative to certain embodiments and figures, all embodiments of the present invention can include one or more of the features discussed herein. While one or more embodiments may be discussed as having certain advantageous features, one or more of such features may also be used with the various embodiments of the invention discussed herein. In similar fashion, while exemplary embodiments may be discussed below as system or method embodiments, it is to be understood that such exemplary embodiments can be implemented in various devices, systems, and methods of the present invention.

BRIEF DESCRIPTION OF THE DRAWINGS

The following Detailed Description of the Invention is better understood when read in conjunction with the appended drawings. For the purposes of illustration, there is shown in the drawings exemplary embodiments, but the subject matter is not limited to the specific elements and instrumentalities disclosed.

DETAILED DESCRIPTION OF THE INVENTION

Figure 1:
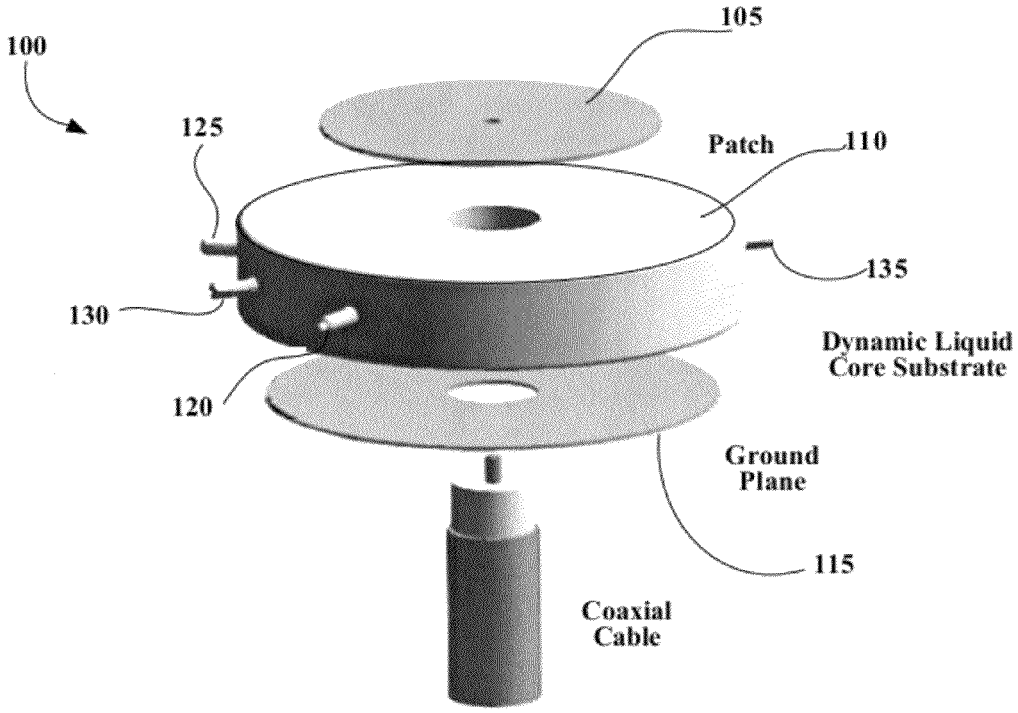
FIG. 1 provides a tunable liquid core patch antenna, in accordance with an exemplary embodiment of the present invention.

To facilitate an understanding of the principles and features of the present invention, various illustrative embodiments are explained below. In particular, the invention is described in the context of being dynamically tunable liquid core patch antennas. Embodiments of the present invention may be applied to many systems where it is desirable to dynamically alter the operating resonant frequency of antenna, including, but not limited to, communication systems, joint counter-radio controlled improvised explosion device electronic warfare ("JCREW") systems, transmitters, receivers, and the like.

The components described hereinafter as making up various elements of the invention are intended to be illustrative and not restrictive. Many suitable components or steps that would perform the same or similar functions as the components or steps described herein are intended to be embraced within the scope of the invention. Such other components or steps not described herein can include, but are not limited to, for example, similar components or steps that are developed after development of the invention.

The resonant length of a simple rectangular microstrip patch antenna that has a substrate thickness less than $0.006\lambda_d$, where $\lambda_d$ is the wavelength in the dielectric substrate, may be described by Equation 1.

$$L = \frac{\lambda_0}{2\sqrt{\varepsilon_{eff}}} - 2\left[0.412h\frac{(\varepsilon_{eff}+0.300)(W/h+0.264)}{(\varepsilon_{eff}-0.258)(W/h+0.813)}\right] \quad \text{Equation 1}$$

In Equation 1, $\lambda_d$ is the freespace wavelength, h is the substrate height, W is the resonant width of the patch, and $\in_{eff}$ is the effective permittivity. The effective permittivity can be defined by Equation 2.

$$\varepsilon_{eff} = \frac{(\varepsilon_r+1)}{2} + \frac{(\varepsilon_r-1)}{2}1 + \left(1+\frac{10h}{W}\right)^{1/2} \quad \text{Equation 2}$$

In Equation 2, $\in_r$ is the relative permittivity of the microwave substrate. The formulations in Equations 1 and 2 permit recognition that the fringing fields extend beyond the edges of the patch, so that the electrical length, L, is a function of the physical and electrical properties of the substrate. Consequently, the effective permittivity, $\in_{eff}$, is used instead of the relative permittivity to determine the operating resonant frequency, $f_r$, of the antenna, in recognition that fringing fields have an effect of modifying the resonance. The operating resonant frequency of a patch antenna can be described as a function of the resonant length and effective permittivity as shown in Equation 3.

$$f_r = \frac{c_0}{2L\sqrt{\varepsilon_{eff}}} \quad \text{Equation 3}$$

In Equation 3, $c_0$=2.998×108 m/s is the approximate velocity of the electromagnetic field in free space. As shown in Equation 3, the resonant frequency of a patch antenna is based in part on the dielectric properties of the substrate of the patch antenna. This recognition is foundational in the development of wide-bandwidth tunable antennas.

Part of the appeal of microstrip patch antennas is in their ease of manufacturing. This convenience, however, is often accomplished with patch development on top of a solid core substrate. As a consequence, modification of the dielectric constant of the substrate has not been readily conceivable. Thus, tuning these conventional patch antennas, without altering the reactance at the edges of the antennas, required removing the solid substrate and replacing it with a different substrate having a different dielectric constant. This is a very tedious process, which doesn't allow for the dynamic tuning of antennas during continuous operation of the antenna.

Accordingly, the present invention provides liquid core patch antennas, which have a liquid core substrate with dielectric properties that can be dynamically altered during operation of the antenna, thus tuning the operating resonant frequency of the antenna.

As shown in FIG. 1, an exemplary embodiment of the present invention provides a liquid core patch antenna 100 that can be tuned to a desired operating resonant frequency. The antenna comprises a top-side patch 105, a ground plane 115, and a liquid core substrate 110. The liquid core substrate can be positioned substantially between the top-side patch 105 and the ground plane 115. The liquid core substrate 110 can comprise a first liquid and a second liquid. The first liquid and second liquid can be located within a core of the liquid core substrate 110. The core can be defined by walls of the substrate 110. The first liquid can have a first set of dielectric properties, and the second liquid can have a second set of dielectric properties. In an exemplary embodiment of the present invention, the first liquid is associated with a first dielectric constant, and the second liquid is associated with a second dielectric constant. In an exemplary embodiment of the present invention, the second dielectric constant is greater than the first dielectric constant. The first liquid and second liquid can form a mixture having an effective dielectric constant. The effective dielectric constant can have a value greater than the first dielectric constant of the first liquid and less than the second dielectric constant of the second liquid.

As shown in Equation 3, there is an inverse square relationship between the resonant frequency and dielectric constant, such that as the permittivity of the substrate 110 decreases, the resonant frequency increases. Further, the resonant frequency is a function of the permittivity, i.e. dielectric constant, of the substrate 110, and the mixture of the first and second liquids can have an effective dielectric constant ranging from the first dielectric constant of the first liquid to the second dielectric constant of the second liquid. Therefore, for an exemplary embodiment of the present invention, it can be desirable to choose a first liquid having a low dielectric constant and choose a second liquid having a high dielectric constant, thus increasing the tuning range of the liquid core patch antenna 100.

The first and second liquids can be many liquids known in the art, including, but not limited to, de-ionized water, Toulene, and the like. In some embodiments of the present invention, the first and second liquids are low-loss liquids.

In an exemplary embodiment of the present invention, the first liquid can be Toulene, which has a dielectric constant of about 2.38 and a loss tangent of about 0.040, and the second liquid can be de-ionized water, which has a dielectric constant of about 80.1 and a loss tangent of about 0.123. If these two low-loss dielectric liquids are applied to a circular liquid core substrate 110, Equations 2 and 3 can be used to yield Equation 4.

$$a = \frac{A_{nm} \cdot c_0}{2\pi\sqrt{\varepsilon_r}}\left[1 + \frac{2h}{\pi a \varepsilon_r}\left(\ln\left\{\frac{\pi a}{2 f_{nm} h}\right\} + 1.7726\right)\right]^{-1/2} \qquad \text{Equation 4}$$

Figure 2:
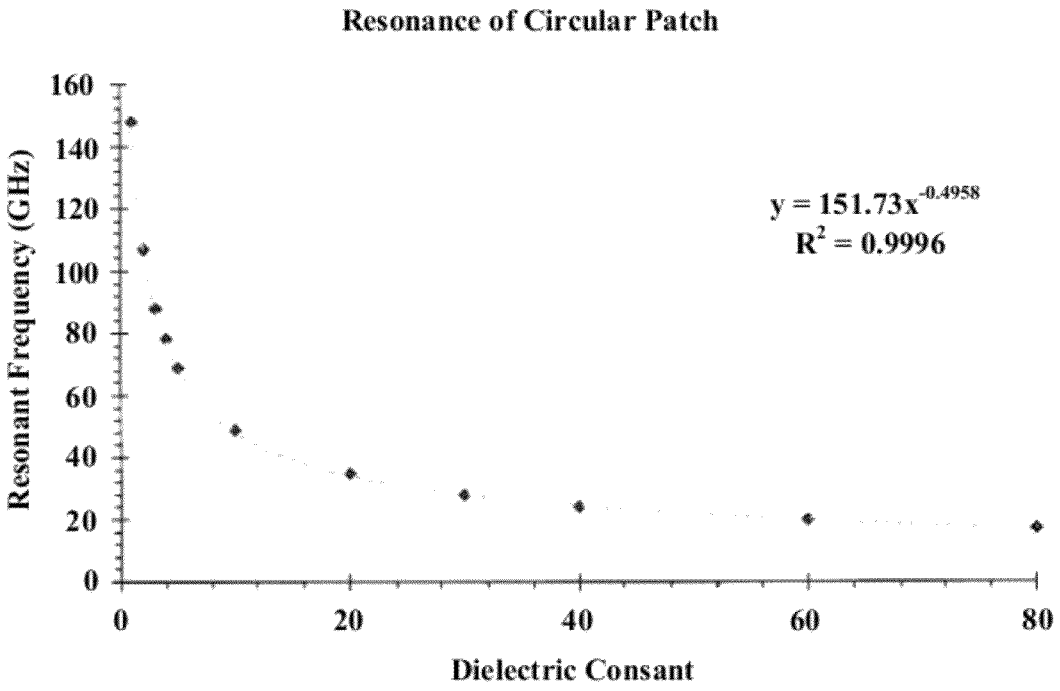
FIG. 2 provides a plot of the operating resonant frequency of an antenna versus the effective dielectric constant of the antenna's liquid core substrate, in accordance with an exemplary embodiment of the present invention.

In Equation 4, $A_{nm}$, is the zero of a Bessel function of the (n,m) order, and $f_{nm}$ is the corresponding resonant frequency. An exemplary embodiment of the present invention with a substrate that is 25 mils in height and a patch with a 25 mil radius can yield a tunable bandwidth exceeding 8.5:1. FIG. 2 provides a plot illustrating resonant frequencies achieved by varying the concentrations of the first liquid and second liquid, making up the mixture, in accordance with an exemplary embodiment of the present invention.

In some embodiments of the present invention, a plurality of patch antennas 100 having radii of differing lengths can be used to achieve a system that can be tuned over a large range of frequencies, e.g. low-frequency ("LF") to extremely high frequency ("EHF"). The achievable frequency bands for an exemplary embodiment of the present invention employing four patch antennas 100 is shown in Table 1.

TABLE 1

Tunable Bandwidths for an Exemplary Circular Patch Antenna of Varied Radii

| a (mils) Radius | $f_U$ (GHz) Upper Resonance using $\epsilon_r = 1$ | $f_L$ (GHz) Lower Resonance using $\epsilon_r = 80$ | $BW_T$ (GHz) Total Tunable Bandwidth | $BM_F$ (GHz) Fractional Tunable Bandwidth |
|---|---|---|---|---|
| 25 | 148 | 17.4 | 130.6 | 8.5:1 |
| 294 | 17.4 | 2.0 | 15.4 | 8.7:1 |
| 2800 | 2.0 | 0.227 | 1.77 | 8.8:1 |
| 5000 | 1.1 | 0.128 | 0.972 | 8.6:1 |

The walls liquid core substrate 110 can be made of many different materials in accordance with various exemplary embodiments of the present invention. In an exemplary embodiment of the present invention, walls of the liquid core substrate 110 comprise glass, e.g. 7059 Glass manufactured by Corning®. The scope of the present invention, however, is not limited to glass. Instead, as those skilled in the art would understand, the walls of the liquid core substrate 110 can be made of other materials, including, but not limited to, polymers, plastics, and the like.

The top-side patch 105 and ground plane 115 can comprise many different materials. In an exemplary embodiment of the present invention, at least one of the top-side 105 patch and the ground plane 115 comprises an electrically conductive material. The electrically conductive material can be many electrically conductive materials known in the art, including, but not limited to, copper, gold, silver, and the like, or any combination thereof.

In another exemplary embodiment of the present invention, the antenna 100 comprises a first liquid inlet 120 in fluid communication with the liquid core substrate 110. The first liquid inlet 120 can be configured to inject the first liquid into the liquid core substrate 110. In another exemplary embodiment of the present invention, the antenna 100 comprises a second liquid inlet 125 in fluid communication with the liquid core substrate 110. The second liquid inlet 125 can be configured to inject the second liquid into the liquid core substrate 110. In yet another exemplary embodiment of the present invention, the first and second liquid inlets 120 125 can be in communication with first and second reservoirs (not shown), respectively, containing the first and second liquids, respectively. Thus, a portion of the first liquid held in the first reservoir can be injected through the first liquid inlet 120 and into the liquid core substrate 110. Similarly, a portion of the second liquid held in the second reservoir can be injected through the second liquid inlet 125 and into the liquid core substrate 110.

In still another exemplary embodiment of the present invention, the first liquid and the second liquid can be injected into the liquid core substrate 110 via the same liquid inlet or plurality of liquid inlets. For example, the first and second liquids can be mixed with each other outside of the liquid core substrate, and the mixture of the first and second liquids can be injected into the liquid core substrate via one or more liquid inlets.

In yet another exemplary embodiment of the present invention, the antenna 100 comprises a liquid outlet 135 in fluid communication with the liquid core substrate 110. The liquid outlet 135 can be configured to eject at least a portion of the mixture out of the liquid core substrate 110. For example, if the volume of the liquid core substrate 110 is filled with the mixture of the first and second liquids and an amount of the first or second liquid needs to be injected into the liquid core substrate 110 to alter the operating resonant frequency of the antenna 100, an amount of the mixture can be ejected from the liquid core substrate 110, making room for the additional first or second liquid. In an exemplary embodiment of the present invention, a portion of the mixture is ejected through the liquid outlet 135 prior to injecting the additional first or second liquid into the liquid core substrate 110. In another exemplary embodiment of the present invention, a portion of the mixture is ejected from the liquid core substrate 110 substantially simultaneously as an additional amount of the first or second liquid is injected into the liquid core substrate 110.

In some embodiments of the present invention, injecting the first and/or second liquids into the liquid core substrate 110 causes the injected liquid to mix with the mixture previously located in the liquid core substrate 110. In an exemplary embodiment of the present invention, the first and second inlets 120 125 are oriented to cause the injected fluids to agitate the mixture and mix with the previously existing mixture. In another exemplary embodiment of the present invention, the antenna 100 comprises a mixing element which agitates the first liquid, second liquid, and/or mixture, causing the liquids to mix with each other. In some embodiments of the present invention, the mixing element is positioned within the liquid core substrate 110. In some embodiments of the present invention, the mixing element is positioned within one or more of the liquid inlets 120 125. The mixing element can be many mixing elements known in the art and configured to agitate or disperse the first liquid, the second liquid, or the mixture, including, but not limited to, a nozzle, an injection inlet/port, a plurality of injection inlets/ports, a rotating or actuating member, and the like.

In another exemplary embodiment of the present invention, the antenna 100 comprises a pressure relief port 130. The pressure relief port 130 can be in fluid communication with the liquid core substrate 110. The pressure relief port 130 can be configured to regulate pressure of the mixture within the liquid core substrate 130. In an exemplary embodiment of the present invention, the pressure relief port 130 comprises a pressure sensitive valve that opens when the pressure within the liquid core substrate 110 exceeds a predetermined threshold.

Figure 3A:
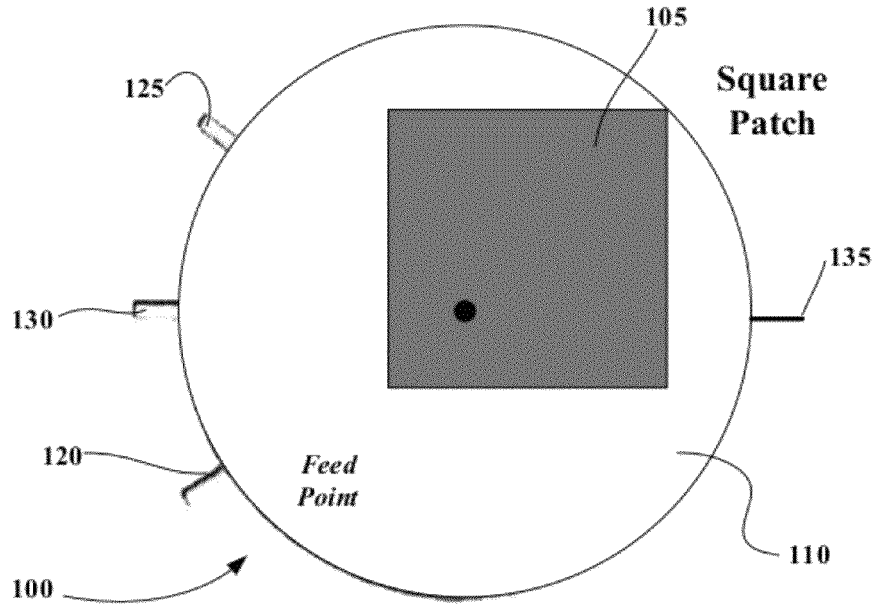
FIGS. 3A-3B provide tunable liquid core patch antennas, in accordance with exemplary embodiments of the present invention.
Figure 3B:
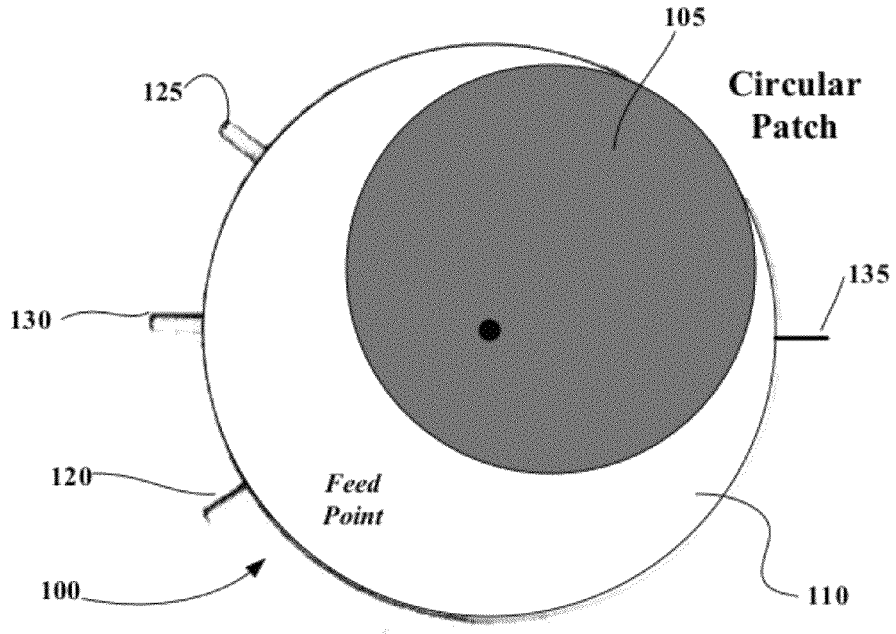

The top-side patch 105, liquid core substrate 110, and ground plane 115 of the present invention are not limited to any particular shape. Instead, the scope of the present invention includes components of many different shapes. As shown in FIG. 3A, the top-side patch 105 and liquid core substrate 110 are circular-shaped, in accordance with an exemplary embodiment of the present invention. Alternatively, as shown in FIG. 3B, the top-side patch 105 is rectangular-shaped and the liquid core substrate 110 is circular-shaped, in accordance with another exemplary embodiment of the present invention. When a square or rectangular-shaped patch 105 is used, the length and width of the patch 105 can be chosen to alter the radiation efficiency and polarization of the antenna.

Figure 4:
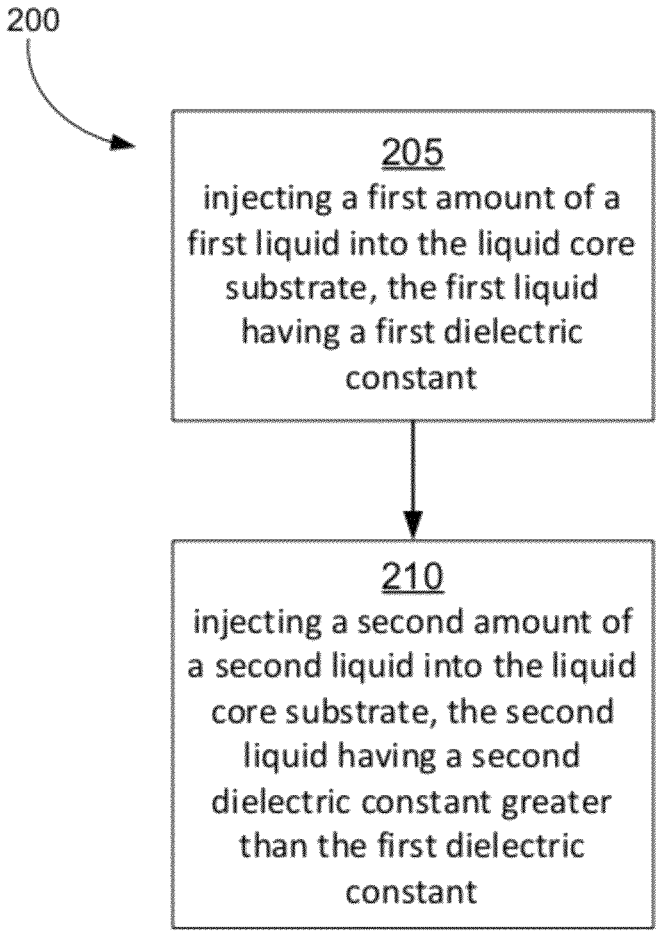
FIG. 4 provides a block diagram of a method of tuning an antenna, in accordance with an exemplary embodiment of the present invention.

In addition to tunable liquid core patch antennas, the present invention provides methods of dynamically tuning an antenna to a desired operating resonant frequency. As shown in FIG. 4, an exemplary method 200 comprises injecting a first amount of a first liquid into the liquid core substrate, the first liquid having a first dielectric constant 205, and injecting a second amount of a second liquid into the liquid core substrate, the second liquid having a second dielectric constant greater than the first dielectric constant 210. The first amount of the first liquid and the second amount of the second liquid can form a mixture having an effective dielectric constant greater than the first dielectric constant and less than the second dielectric constant. The effective dielectric can correspond to the desired operating frequency. Accordingly, by varying the amounts of the first and second liquids injected into the liquid core substrate, the effective dielectric constant of the mixture, and thus the operating resonant frequency of the antenna, can be controlled.

In another exemplary embodiment of the present invention, the method 200 further comprises injecting a third amount of one of the first liquid and second liquid into the liquid core substrate. The third amount of the first or second liquid mixes with the previous mixture—the first amount of the first liquid and the second amount of the second liquid—in the liquid core substrate to alter the effective dielectric constant of the mixture. By altering the effective dielectric constant of the mixture, the operating resonant frequency of the antenna can be altered as desired.

In an exemplary embodiment of the present invention, injecting the first amount of the first liquid and injecting the second amount of the second liquid can occur during continuous operation of the antenna. In another exemplary embodiment of the present invention, the injecting the third amount of the first or second liquid can occur during continuous operation of the antenna. Thus, the present invention allows the antenna to be dynamically tuned to a desired operating resonant frequency without taking the antenna out of operation to tune the antenna.

In some embodiments of the present invention, the first amount of the first liquid is injected via a first liquid inlet, and the second amount of the second liquid is injected via a second liquid inlet. In some embodiments of the present invention, the first and second liquids are injected via the same liquid inlet. In an exemplary embodiment of the present invention, the first amount of the first fluid and second amount of the second fluid are mixed to form a mixture prior to being injected via the liquid inlet.

In some embodiments of the present invention, the method 200 further comprises mixing the first amount of the first liquid and the second amount of the second liquid to form a mixture. In an exemplary embodiment of the present invention, mixing the first and second liquids comprises injecting the liquids into the liquid core substrate via a plurality of fluid inlets, such that the liquids are agitated and dispersed throughout the liquid core substrate. In some embodiments of the present invention, the first and second liquids mix to form a homogeneous mixture. In another exemplary embodiment of the present invention, the first and second liquids mix to form a heterogeneous mixture.

In another exemplary embodiment of the present invention, at least one of the first liquid and second liquid comprises solid particles. The solid particles can be chosen to alter the dielectric properties of the mixture.

It is to be understood that the embodiments and claims disclosed herein are not limited in their application to the details of construction and arrangement of the components set forth in the description and illustrated in the drawings. Rather, the description and the drawings provide examples of the embodiments envisioned. The embodiments and claims disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the claims be regarded as including such equivalent constructions.

Furthermore, the purpose of the foregoing Abstract is to enable the United States Patent and Trademark Office and the public generally, and especially including the practitioners in the art who are not familiar with patent and legal terms or phraseology, to determine quickly from a cursory inspection the nature and essence of the technical disclosure of the application. The Abstract is neither intended to define the claims of the application, nor is it intended to be limiting to the scope of the claims in any way. It is intended that the application is defined by the claims appended hereto.

What is claimed is:

1. A tunable liquid core patch antenna comprising:

a top-side patch;

a ground plane;

a liquid core substrate positioned substantially between the top-side patch and the ground plane, wherein the liquid core substrate comprises:

a first liquid having a first dielectric constant; and a second liquid having a second dielectric constant greater than the first dielectric constant, and wherein the first liquid and second liquid form a mixture having an effective dielectric constant greater than the first dielectric constant and less than the second dielectric constant; and a mixing element configured to mix the first liquid and the second liquid to form the mixture.

2. The tunable liquid core patch antenna of claim 1, further comprising:

a first liquid inlet in fluid communication with the liquid core substrate and configured to inject the first liquid into the liquid core substrate; and a second liquid inlet in fluid communication with the liquid core substrate and configured to inject the second liquid into the liquid core substrate.

3. The tunable liquid core patch antenna of claim 1, further comprising a liquid outlet in fluid communication with the liquid core substrate and configured to eject at least a portion of the mixture out of the liquid core substrate.

4. The tunable liquid core patch antenna of claim 1, wherein at least one of the top-side patch and ground plane comprises at least one electrically conductive material.

5. The tunable liquid core patch antenna of claim 1, wherein the effective dielectric constant corresponds to an operating resonant frequency of the patch antenna.

6. The tunable liquid core patch antenna of claim 1, further comprising a pressure relief port in fluid communication with the liquid core substrate configured to regulate a pressure of the mixture within the liquid core substrate.

* * * * *